US006622686B2

(12) United States Patent
Komatsuda et al.

(10) Patent No.: US 6,622,686 B2
(45) Date of Patent: Sep. 23, 2003

(54) CYLINDER HEAD FOR AN INTERNAL COMBUSTION ENGINE

(75) Inventors: Takashi Komatsuda, Saitama (JP); Kaoru Aoki, Saitama (JP); Shinichi Takahashi, Saitama (JP); Takuya Takagi, Saitama (JP); Hiromu Nakamura, Saitama (JP); Tsutomu Yamasaki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/779,630

(22) Filed: Feb. 9, 2001

(65) Prior Publication Data

US 2001/0013326 A1 Aug. 16, 2001

(30) Foreign Application Priority Data

Feb. 10, 2000 (JP) ..... P. 2000-034166

(51) Int. Cl.[7] ..... F02F 1/24; F02F 1/36
(52) U.S. Cl. ..... 123/193.5
(58) Field of Search ..... 123/193.5

(56) References Cited

U.S. PATENT DOCUMENTS 4,621,597 A * 11/1986 Kawada et al. ..... 123/193.5
4,644,910 A * 2/1987 Kawamura ..... 123/193.5
4,690,105 A * 9/1987 Kanda ..... 123/193.5
4,700,665 A * 10/1987 Kanda ..... 123/193.5
4,730,579 A * 3/1988 Yamada et al. ..... 123/193.5
4,951,623 A * 8/1990 Jingu et al. ..... 123/193.5
5,682,850 A 11/1997 Matayoshi
5,765,520 A * 6/1998 Adachi et al. ..... 123/193.5
5,964,196 A * 10/1999 Sigle et al. ..... 123/193.5
6,024,057 A * 2/2000 Betchaku ..... 123/193.5
6,123,055 A * 9/2000 Takeuchi et al. ..... 123/193.5
6,138,631 A * 10/2000 Stromsky et al. ..... 123/193.5
6,205,974 B1 * 3/2001 Yonezawa et al. ..... 123/193.5

FOREIGN PATENT DOCUMENTS

DE 196 08 576 C1 6/1997
DE 196 37 122 C1 1/1998

* cited by examiner

*Primary Examiner*—Marguerite McMahon
(74) *Attorney, Agent, or Firm*—Arent Fox Kintner Plotkin & Kahn, PLLC

(57) ABSTRACT

In a cylinder head 1 of an internal combustion engine, communicating passageways 17, 18, 17', 18' for coolant are provided between combustion chambers 3 and pass-through holes 21 to 28 at positions which overlap straight lines L1, L2 connecting centers C2, C3 of the exhaust port openings 6*a*, 7*a* with centers C5 to C8 of the pass-through holes 25 to 28 and straight lines L3, L4 connecting centers C9, C10 of the intake port openings 4*a*, 5*a* with centers C11 to c14 of the pass-through holes 21 to 24 when a mating surface 2 of the cylinder head 1 with the cylinder block is viewed from the bottom. When peripheries of the exhaust port openings 6*a*, 7*a* and intake port openings 4*a*, 5*a* thermally expand, the suppression of thermal expansion by the bolts at fastening portions is alleviated by the communicating passageways 17, 18, 17', 18'.

3 Claims, 4 Drawing Sheets

CYLINDER HEAD FOR AN INTERNAL COMBUSTION ENGINE

BACKGROUND OF THE INVENTION

1. Field of the Invention

The present invention relates to a cylinder head for an internal combustion engine. More particularly, the invention relates to a cylinder head having pass-through holes through which fasteners are passed for fastening the cylinder head to a cylinder block to suppress the deformation of intake port openings which are opened and/or closed by intake valves due to thermal expansion at the periphery of the intake port openings. The cylinder head can also be used to suppress the deformation of exhaust port openings which are opened and/or closed by exhaust valves due to thermal expansion at the periphery of the exhaust port openings.

2. Description of the Related Art

In an internal combustion engine, a cylinder head having provided therein intake port openings and exhaust port openings which are opened and/or closed by intake valves and exhaust valves, respectively, is a part of the engine which reaches a rather high-temperature because it is exposed to combustion gas. The peripheries of the intake port openings and the exhaust port openings also reach a rather high-temperature. On the other hand, a plurality of fastening bolt pass-through holes are formed in the cylinder head radially outwardly of the intake and exhaust port openings along the peripheries of combustion chambers. Thus, the cylinder head is fastened to the cylinder block with fastening bolts inserted through corresponding fastening bolt pass-through holes.

Then, the highly heated peripheral portions of the intake and exhaust port openings tend to thermally expand towards the peripheries thereof in a substantially uniform manner. As shown in FIG. 7, however, fastening portions are provided radially outwardly of intake port openings a and exhaust port openings b. The fastening portions are fastened by fastening bolts inserted through pass-through holes c. Therefore, when a mating surface of the cylinder head with the cylinder block is viewed from the bottom, the fastening portions restrain thermal expansions in directions along straight lines d which connect the centers of either the intake port openings a or the exhaust port openings b with the centers of the pass-through holes c and in particular thermal expansions in directions along the straight lines d in the vicinity of portions where the peripheral portions of the intake port openings a or the exhaust port openings b overlap the straight lines d. As such, the peripheries of the intake port openings a or the exhaust port openings b cannot expand uniformly, which leads to the intake port openings a or the exhaust port openings b, which are each substantially round, being deformed to form non-circular shapes. Simultaneously, thermal stress converges on areas f on the peripheries of the intake port openings a or the exhaust port openings b and in the vicinity of portions which overlap straight lines e which pass through the centers of the intake port openings a or the exhaust port openings b and intersect with the straight lines d. As a result, creep deformations are generated in the areas f due to the thermal stress, which causes the intake port openings a or the exhaust port openings b to be further deformed and non-circular in shape. Note that reference character g denotes an opening through which a spark plug faces the combustion chamber.

When the intake port openings or the exhaust port openings deform as described above, the sealing properties of the intake valve or the exhaust valve deteriorate. This causes a leakage of unburned air-fuel mixture from between the intake valves and the intake port openings, or between the exhaust valves and the exhaust port openings during a compression stroke. Then, in the event that unburned air-fuel mixture leaks from between the intake valves and the intake port openings, since fuel flows back to the intake ports, the accuracy at which the air-fuel ratio is controlled may be badly affected. In the event that unburned air-fuel mixture leaks from between the exhaust valves and the exhaust port openings, the amount of HC in exhaust gas increases, resulting in deterioration in exhaust emissions.

Then, in order to prevent the reduction in sealing properties of the intake valves or exhaust valves resulting from the deformation of the intake port openings or exhaust port openings due to thermal expansions or creep deformation in the peripheral portions of the intake or exhaust port openings, conventionally, a certain limit is imposed on the maximum combustion temperature of the internal combustion engine or the capacity of the coolant jacket in the cylinder head is increased so as to improve the cooling performance. Thus, the deformation of the intake port openings or exhaust port openings is suppressed to thereby secure the sealing properties of the intake or exhaust valves.

Limiting the maximum combustion temperature of an internal combustion engine, however, sets a limit to the output of the engine, and in the case of an automotive internal combustion engine, for example, the running performance of an automotive vehicle is limited, which incorporates an internal combustion engine whose maximum combustion temperature is limited. Thus, since limiting the maximum combustion temperature of an internal combustion engine leads to limiting the operating performance of an apparatus incorporating the internal combustion engine, an improvement thereto has been desired. In addition, the enlargement of the cooling mechanism with a view to improving the cooling performance, such as increasing the capacity of the cooling water jacket, leads to the enlargement of the cylinder head, thus limiting the degree of freedom in the layout of the internal combustion engine.

SUMMARY OF THE INVENTION

The present invention was made in view of these situations and an object thereof is to maintain a high engine output with a simple structure and to secure good sealing properties of intake or exhaust valves without the enlargement of a cylinder head being involved.

According to a first aspect of the invention, there is provided a cylinder head for an internal combustion engine adapted to be fastened to a cylinder block with the fasteners. The cylinder head includes combustion chambers, intake port openings and exhaust port openings which are opened and/or closed by intake valves and exhaust valves, respectively. Pass-through holes are also included through which fasteners are passed. Space portions are provided between the combustion chambers and the pass-through holes at positions which overlap straight lines connecting the centers of the intake port openings or the exhaust port openings with the pass-through holes when a mating surface of the cylinder head with the cylinder block is viewed from the bottom.

According to the first aspect of the invention, when the peripheries of the intake port openings or the exhaust port openings are thermally expanded, the suppression of thermal expansion by the fastening portions on the cylinder head where the cylinder head is fastened to the cylinder block with fasteners is alleviated by the space portions in the peripheries of the intake port openings or exhaust port openings. The thermal expansion is suppressed in the vicinity of the portions which overlap the straight lines when the mating surface of the cylinder head with the cylinder block is viewed from the bottom thereof. Therefore, thermal expansion is permitted and the peripheries of the intake port openings or exhaust port openings thermally expand in the directions along the straight lines. Due to this, the deformation of the intake port openings or exhaust port openings based on the suppression of thermal expansion by the fastening portions on the cylinder head is suppressed. Moreover, the convergence of thermal stress occurring by the suppression of thermal expansion is reduced in the areas near the portions of the peripheries of the intake port openings or exhaust port openings which overlap the straight lines passing through the centers of the intake port openings or exhaust port openings and intersecting with the straight lines substantially at right angles. Thus, the intake port openings or exhaust port openings are allowed to maintain shapes close to their substantially round shapes provided before the peripheries of the intake port openings or exhaust port openings are thermally expanded.

As a result, even when the peripheries of the intake port openings or exhaust port openings are thermally expanded, with the simple structure in which the space portions are provided in the cylinder head, good sealing properties of the intake valves or exhaust valves can be obtained. This suppresses the leakage of unburned air-fuel mixture into the intake port openings during compression strokes, wherein the accuracy at which the air-fuel ratio is controlled can be properly maintained. In addition, similarly, the above-described structure suppresses the leakage of unburned air-fuel mixture into the exhaust ports during compression strokes, wherein exhaust emissions can be improved. Moreover, combustion at as high a maximum combustion temperature as the thermal expansion is permitted by the space portions is possible, so that high engine output can be maintained. Furthermore, there is no risk that the cylinder head is enlarged, so no limitation is imposed as to the layout of the internal combustion engine.

According to a second aspect of the invention, since the degree of alleviation of the suppression of thermal expansion by the fastening portions on the cylinder block can be substantially equalized on sides of the straight lines, the peripheries of the intake port openings or exhaust port openings can be thermally expanded more uniformly. Thus, the shapes of the intake port openings or exhaust port openings can be maintained to those which are closer to the substantially round shapes. As a result, in addition to the effectiveness provided by the first aspect of the invention, better sealing properties of the intake valves or exhaust valves can be secured. Thus, the accuracy at which the air-fuel ratio is controlled can be properly maintained and the exhaust emissions can be further improved.

According to a third aspect of the invention, there is provided a cylinder head for an internal combustion engine, as set forth in the first and second aspects of the invention, wherein the space portions constitute coolant passageways.

According to the third aspect of the invention, the suppression of thermal expansion by the fastening portions on the cylinder head is alleviated by the coolant passageways which are constituted by the space portions. At the same time, the peripheries of the intake port openings or exhaust port openings are cooled with coolant flowing through the space portions. As such, the thermal expansions in the peripheries of the intake port openings or exhaust port openings are reduced. Therefore, since the deformation of the intake port openings or exhaust port openings, and the occurrence of the convergence of thermal stress are further suppressed, the shapes of the intake port openings or exhaust port openings can be maintained to those closer to their substantially round shapes provided before the peripheries of the intake port openings or exhaust port openings are thermally expanded.

As a result, in addition to the effectiveness provided by the first and second aspects of the invention, with the simple structure in which the coolant passageways are constituted by the space portions, better sealing properties of the intake valves or exhaust valves are obtained, the accuracy at which the air-fuel ratio is controlled is better maintained, and exhaust emissions are better improved.

DETAILED DESCRIPTION OF THE PREFERRED EMBODIMENTS

Referring to FIGS. 1 to 5, a description will be given of embodiments of the invention.

Figure 1:
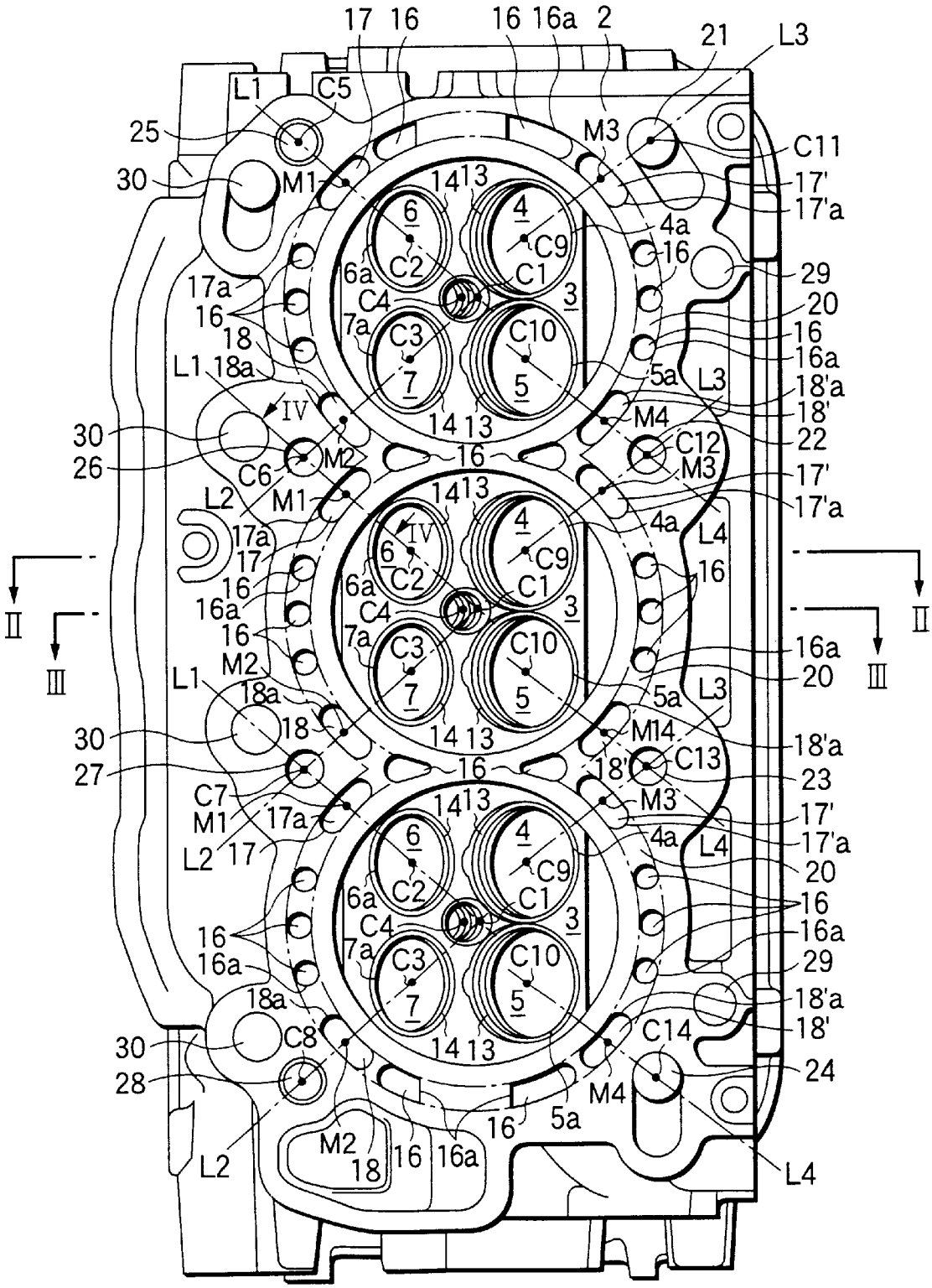
FIG. 1 is a plan view of a first embodiment of the invention as viewed from a mating surface of a cylinder head of an internal combustion engine.

In a first embodiment, an internal combustion engine is a V-6 spark ignition SOHC water-cooled internal combustion engine adapted to be provided on an automotive vehicle. The internal combustion engine comprises a cylinder block of aluminum alloy having a pair of banks arranged in a V-shape and a pair of aluminum alloy cylinder heads fastened to the respective banks of the cylinder block. FIG. 1 shows a mating surface 2 of the cylinder head 1 of one bank of the pair of banks which mates with the cylinder block (not shown). Note that in the following description, while mainly the cylinder head 1 and the cylinder block on one of the pair of banks will be described, the cylinder head and the cylinder block on the other bank are basically constructed in the same way.

Each of the banks of the cylinder block has three cylinder portions arranged along an axial direction of a crankshaft rotatably supported on the cylinder block. The cylinder head 1 has three pent roof type combustion chambers 3 which are concaved in the cylinder head 1 and are arranged in the axial direction of the crankshaft (hereinafter, referred to as the "arrangement direction") so as to face cylinder bores formed in the respective cylinder portions for pistons to fit therein, respectively, for reciprocating movement.

Figure 2:
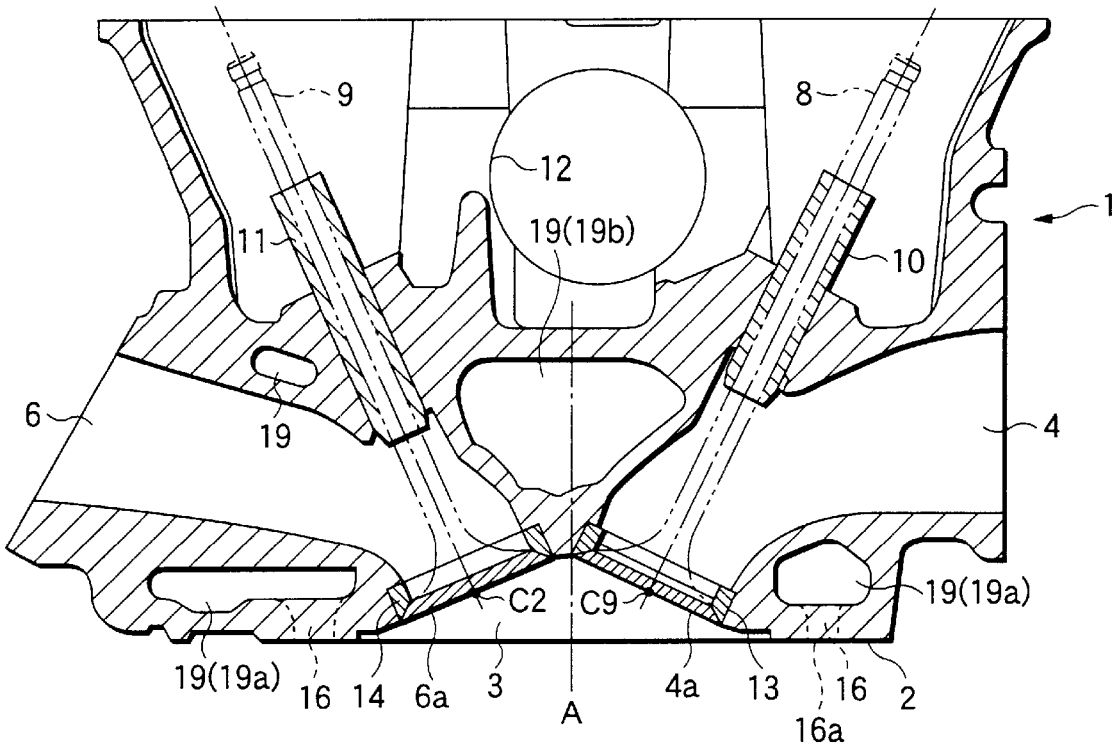
FIG. 2 is a sectional view taken along the line II—II of FIG. 1.
Figure 3:
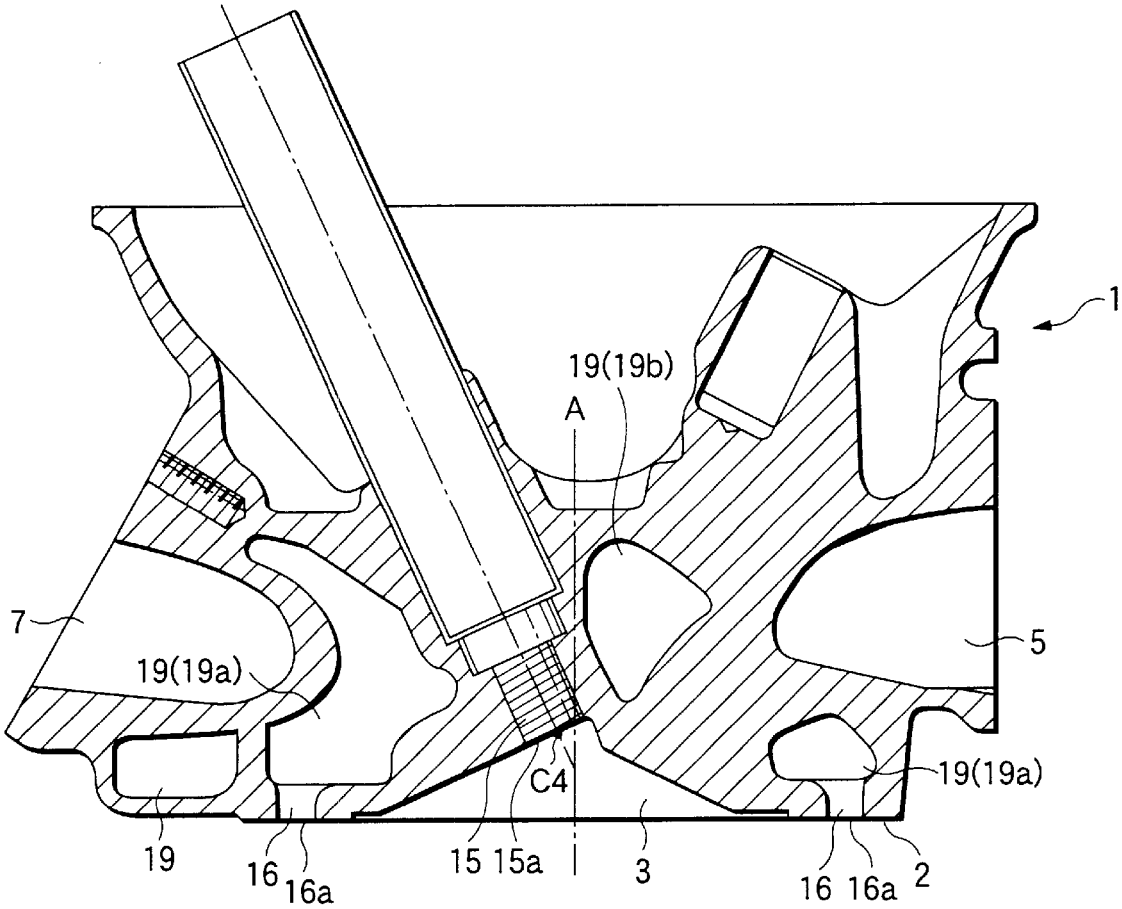
FIG. 3 is a sectional view taken along the line III—III of FIG. 1.

Referring to FIGS. 2 and 3 in combination, formed in each combustion chamber 3 are substantially round intake port openings 4*a*, 5*a* which are combustion chamber 3 side opening ends of a pair of intake ports 4, 5 provided in the cylinder head 1. The intake ports 4, 5 are opened and/or closed by a pair of intake valves 8. Substantially round exhaust port openings 6*a,* 7*a,* which are combustion chamber 3 side opening ends of a pair of exhaust ports 6, 7, are provided in the cylinder head 1. The exhaust ports 6, 7 are opened and/or closed by a pair of exhaust valves 9.

The intake valves 8 are inclined toward the intake ports 4, 5 side relative to a center line A of the cylinder bore. The exhaust valves 9 are inclined toward the exhaust ports 6, 7 side relative to the same center line A. The intake and exhaust valves 8 and 9 are operated to be opened and/or closed by a valve train comprising a camshaft (not shown) rotatably supported in a supporting hole 12 provided in the cylinder head 1 and rocker arms adapted to be rocked by cams provided on the camshaft. The intake valves 8 and the exhaust valves 9 are slidably fitted, respectively, in guide tubes 10, 11 which are press fitted in the cylinder head 1. The valve train is disposed in a valve chamber formed by being tightly closed by a cylinder head cover fastened to the cylinder head 1. In addition, valve seats 13, 14 are press fitted in the respective intake port openings 4*a,* 5*a* and the respective exhaust port openings 6*a,* 7*a* for the intake valves 8 and the exhaust valves 9 to sit thereon.

On a combustion chamber wall surface of each combustion chamber 3, the intake port openings 4*a,* 5*a* are disposed along the arrangement direction and closer to the center of the V-shape formed by the two banks. The exhaust port openings 6*a,* 7*a* are disposed along the arrangement direction and closer to a side end of the V-shape. Furthermore, an opening 15*a* of a mounting hole 15 for a spark plug (not shown) is provided substantially centrally of the combustion chamber wall surface at a position surrounded by both the intake valves 8 and the exhaust valves 9. The mounting hole 15 is located substantially center between the two exhaust valves 9 and has a center line inclined toward the exhaust ports 6, 7 relative to the center line A of the cylinder bore. See FIG. 3.

Provided in the cylinder head 1 so as to surround the respective combustion chambers 3 is a head side coolant jacket 19 which communicates with a block side coolant jacket provided in the cylinder block into which coolant delivered under pressure from a coolant pump is supplied via a plurality of communicating passageways 16, 17, 18, 17', 18', so that coolant from the block side coolant jacket enters and passes through the head side coolant jacket.

The communicating passageways 16, 17, 18, 17', 18' constituting coolant passageways are formed by through holes disposed radially outwardly of the center line A relative to the combustion chamber 3 and at certain intervals along the circumferential direction of the combustion chamber 3. One end of the respective communicating passageways 16, 17, 18, 17', 18' form openings 16*a,* 17*a,* 18*a,* 17'*a,* 18'*a* in the mating surface 2 of the cylinder head 1. The other end thereof is formed to open to the head side coolant jacket 19. Furthermore, the respective communicating passageways 16, 17, 18, 17', 18' extend substantially along the center line A, and the cross-sectional areas and shapes of the respective communicating passageways 16, 17, 18, 17', 18' remain substantially identical to those of the respective openings 16*a,* 17*a,* 18*a,* 17'*a,* 18'*a* at most of the planes parallel to the mating surface 2. Then, the openings 16*a,* 17*a,* 18*a,* 17'*a,* 18'*a* of the respective communicating passageways 16, 17, 18, 17', 18' face coolant passageways formed in a gasket provided between the cylinder block and the cylinder head 1, so that coolant can flow from the block side coolant jacket into the head side coolant jacket 19. In addition, the openings 16*a,* 17*a,* 18*a,* 17'*a,* 18'*a* are disposed on the mating surface 2 within the extent of an annular belt portion 20 (shown by chain double-dashed lines) which has a certain width in the radial direction around the center line A.

The head side coolant jacket 19 includes a coolant passageway 19*a* having an annular shape that surrounds the combustion chamber 3 in the circumferential direction and into which the communicating passageways 16, 17, 18, 17', 18' open. The coolant jacket 19 also includes a coolant passageway 19*b* extending between the intake ports 4, 5 and the exhaust ports 6, 7 in the arrangement direction. The coolant passageways 19*a,* 19*b* communicate with each other.

On the other hand, pass-through holes 21 to 28 through which fastening bolts (not shown) are passed for fastening the cylinder head 1 to the cylinder block are provided radially outwardly of the annular belt portion 20 at the side of the combustion chamber 3, in the arrangement direction with four on the intake ports 4, 5 side, and another four on the exhaust ports 6, 7 side.

The centers C5 to C8 of the pass-through holes 25 to 28 on the side of the exhaust ports 6, 7 are located substantially on straight lines L1, L2, which connect the center C1 of a cylinder bore and centers C2, C3 of exhaust port openings 6*a,* 7*a,* respectively, for each combustion chamber 3, when looking at the mating surface 2 from below. In addition, the centers C6, C7 of the pass-through holes 26, 27, which are located between the adjacent combustion chambers 3, are located, respectively, at intersection points of the straight lines L1, L2 and the straight lines L2, L1 which pass, respectively, through the centers C2, C3 of the exhaust port openings 6*a,* 7*a* and the centers of the exhaust port openings 7*a,* 6*a* of the adjacent combustion chambers 3. One of the exhaust port openings is the exhaust port opening of one of the adjacent combustion chambers 3, which is located closer to the other combustion chamber. The other exhaust port opening is the exhaust port opening of the other combustion chamber, which is located closer to one of the adjacent combustion chambers 3.

Additionally, the pass-through holes 21 to 24 on the side of the intake ports 4, 5 are provided in the mating surface 2 at positions which are substantially symmetrical in a linear manner relative to a line intersecting a plane including the mating surface 2 and a plane including the center line A. Assuming that straight lines connect the centers C11, C12 of the pass-through holes 21, 22, the centers C12, C13 of the pass-through holes 22, 23, and the centers C13, C14 of the pass-through holes 23, 23 for respective combustion chambers 3, the centers C9, C10 of the intake port openings 4*a,* 5*a* of the respective combustion chambers 3 are referred to as straight lines L3, L4, respectively, when looking at the mating surface 2 from below. Then, the centers C12, C13 of the pass-through holes 22, 23, which are located between the adjacent combustion chambers 3, are located at the intersection points of the straight lines L3, L4 and the straight lines L4, L3 which pass, respectively, through the centers C9, C10 of the intake port openings 4*a,* 5*a* and the centers of the intake port openings 5*a,* 4*a* of the adjacent combustion chambers 3. One of the intake port openings is the intake port opening of one of the adjacent combustion chambers 3, which is located closer to the other combustion chamber. The other intake port opening is the exhaust port opening of the other combustion chamber, which is located closer to the other combustion chamber 3.

Additionally, of the pass-through holes 21 to 24 on the side of the intake ports 4, 5, the two pass-through holes 21, 24 are positioned at the ends of the mating surface 2 of the cylinder head 1 in the arrangement direction also function as passageways for supplying lubricating oil for lubrication of the valve train. Furthermore, of the pass-through holes 25 to 28 on the side of the exhaust ports 6, 7, the two pass-through holes 25, 28, which are positioned at the ends of the mating surface 2 of the cylinder head 1, also function as pass-through holes through which cylindrical positioning pins disposed coaxially around the outer circumference of the fastening bolt are passed. Note that reference numeral 29 denotes two through holes constituting breather passageways and reference numeral 30 denotes four return passageways for lubricating oil.

Figure 4:
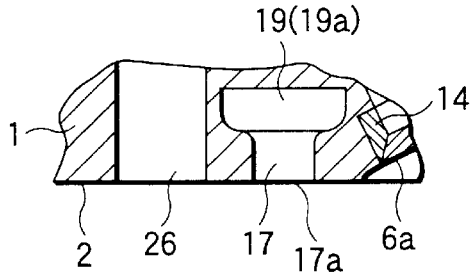
FIG. 4 is a sectional view taken along the line IV—IV of FIG. 1.

With each combustion chamber 3, as shown in FIGS. 1 and 4, the two communicating passageways 17, 18 on the side of the exhaust ports 6, 7 and the two communicating passageways 17', 18' on the side of the intake ports 4, 5 constitute space portions provided in the cylinder head 1 and are located between the combustion chamber 3 and the pass-through holes 25 to 28 on the side of the exhaust ports 6, 7 and between the combustion chamber 3 and the side with the intake ports 4, 5, respectively, at positions which overlap the four straight lines L1, L2, L3, L4 when looking at the mating surface 2 from below. The straight lines L1, L2, L3, L4 pass through M1, M2, M3, M4, which are substantially central positions of the respective communicating passageways 17, 18, 17', 18' in the width direction thereof, which is normal to the straight lines L1, L2, L3, L4 (hereinafter, referred to as an "orthogonal direction").

In this first embodiment, widths of the cross sections of the communicating passageways 17, 18, 17', 18' in the orthogonal direction, including the openings 17*a*, 18*a*, 17'*a*, 18'*a*, are set slightly smaller than the inside diameters of the exhaust port openings 6*a*, 7*a* and the intake port openings 4*a*, 5*a*, respectively. The widths of the communicating passageways, 17, 18, 17', 18' are determined appropriately with a view to permitting thermal expansions in the peripheries of the exhaust port openings 6*a*, 7*a* and the intake port openings 4*a*, 5*a*, which will be described later, so as to suppress the deformation of the exhaust port openings 6*a*, 7*a* and the intake port openings 4*a*, 5*a*, which is attributed to thermal expansion. Similarly, the widths of the cross sections of the communicating passageways 17, 18, 17', 18' in the direction of the respective straight lines L1, L2, L3, L4 are determined appropriately from the same structural point of view. Due to this, there may be a case where the areas and shapes of the openings 17*a*, 18*a*, 17'*a*, 18'*a* of the communicating passageways 17, 18, 17', 18' differ from those of portions of the communicating passageways other than the openings 17*a*, 18*a*, 17'*a*, 18'*a*.

Operation and effectiveness of the first embodiment of the invention as described heretofore are described below.

The peripheries of the exhaust port openings 6*a*, 7*a* and the intake port openings 4*a*, 5*a* of the cylinder head 1 are heated to high temperatures by virtue of combustion of the air-fuel mixture in the combustion chambers 3, which thermally expand to a large extent. As this occurs, the communicating passageways 17, 18, 17', 18' act as the space portions and are provided at positions overlapping the straight lines L1, L2, L3, L4 connecting the centers of the exhaust port openings 6*a*, 7*a* and the intake port openings 4*a*, 5*a* with the centers of the pass-through holes 25 to 28 and the pass-through holes 21 to 24. The suppression of thermal expansion by the fastening portions of the cylinder head 1 where the cylinder head 1 is fastened to the cylinder block by the fastening bolts is alleviated by the communicating passageways 17, 18, 17', 18' in the peripheries of the exhaust port openings 6*a*, 7*a* and the intake port openings 4*a*, 5*a*, in particular, in the vicinity of the portions which overlap the straight lines L1, L2, L3, L4. Thus, thermal expansion is permitted in directions along the straight lines L1, L2, L3, L4.

This not only suppresses the deformation of the exhaust port openings 6*a*, 7*a* and the intake port openings 4*a*, 5*a*, which is attributed to the suppression of thermal expansion by the fastening portions of the cylinder head 1, but also reduces the concentration of thermal stress generated by the thermal expansion in areas in the vicinity of portions which, in the peripheries of the exhaust port openings 6*a*, 7*a* and intake port openings 4*a*, 5*a*, overlap straight lines passing through the centers C2, C3, C9, C10 of the exhaust port openings 6*a*, 7*a* and intake port openings 4*a*, 5*a* and intersecting with the straight lines L1, L2, L3, L4 at substantially right angles. Thus, the shapes of the exhaust port openings 6*a*, 7*a* and intake port openings 4*a*, 5*a* are maintained to be substantially close to the round shapes prior to the occurrence of thermal expansion.

As a result, with the communicating passageways 17, 18, 17', 18' serving as the space portions in the cylinder head 1, good sealing properties of the exhaust valves 9 and intake valves 8 are obtained even when the walls of the combustion chambers, which include the peripheries of the exhaust port openings 6*a*, 7*a* and intake port openings 4*a*, 5*a*, are thermally expanded. As such, leakage of unburned air-fuel mixture into the intake ports, as well as the exhaust ports during a compression stroke, is suppressed and good control accuracy is maintained, the air-fuel mixture ratio is controlled, and the exhaust emissions are improved. Moreover, since combustion at a higher maximum combustion temperature is possible to an extent at which thermal expansion is permitted by the communicating passageways 17, 18, 17', 18', high engine output is maintained. In addition, since the cylinder head 1 does not have to be enlarged, there is no limitation as to the degree of freedom of the lay-out of the internal combustion engine. Furthermore, since there is no likelihood that the weight of the internal combustion engine is increased due to the enlargement of the cylinder head 1, the fuel economy does not deteriorate.

Additionally, since M1, M2, M3, M4, which are substantially the central positions of the widths of the openings 17*a*, 18*a*, 17'*a*, 18'*a* in the orthogonal direction, occupy positions overlapping the straight lines L1, L2, L3, L4, when looking at the mating surface 2 from below as described before. Furthermore, the degree of alleviation of suppression of thermal expansion by the fastening portions of the cylinder head 1 is substantially equal on both sides of the straight lines L1, L2, L3, L4, wherein the walls of the combustion chambers, including the peripheries of the exhaust port openings 6*a*, 7*a* and intake port openings 4*a*, 5*a*, can more uniformly expand to maintain the shapes of the exhaust port openings 6*a*, 7*a* and intake port openings 4*a*, 5*a* to those that are closer to substantially round shapes. As a result, better sealing properties are secured for the exhaust valves 9 and the intake valves 8, good control accuracy is maintained at which the air-fuel mixture ratio is controlled, and the exhaust emissions are further improved.

Furthermore, since the communicating passageways 17, 18, 17', 18' are coolant passageways, not only is the suppression of thermal expansion by the fastening portions alleviated by the communicating passageways 17, 18, 17', 18', but walls of the combustion chambers 3, in their entirety, in particular, the peripheries of the exhaust port openings 6*a*, 7*a* and intake port openings 4*a*, 5*a*, are cooled by coolant flowing through the communicating passageways 17, 18, 17', 18'. As such, thermal expansion of the walls of the combustion chambers 3, in their entirety, in particular, the peripheries of the exhaust port openings 6*a,* 7*a* and intake port openings 4*a,* 5*a,* is reduced to further suppress the deformation of the exhaust port openings 6*a,* 7*a* and intake port openings 4*a,* 5*a,* as well as the concentration of thermal stress generated in the vicinity of those openings due to the suppression of thermal expansion. Accordingly, it is possible to maintain the shapes of the exhaust port openings 6*a,* 7*a* and intake port openings 4*a,* 5*a,* to the shapes which are closer to the substantially round shapes prior to the occurrence of thermal expansion in the peripheries of the exhaust port openings 6*a,* 7*a* and intake port openings 4*a,* 5*a.*

In addition, although the peripheries of the spark plug mounting holes 15 in the cylinder head 1 where combustion is initiated are also heated to temperatures as high as the peripheries of the exhaust port openings 6*a,* 7*a* and intake port openings 4*a,* 5*a,* since the centers C4 of the spark plug mounting holes 15 are located in the vicinity of the straight lines L1, L2, L3, L4 when looking at the mating surface 2 from below, the influence of thermal expansions in the peripheries of the spark plug mounting holes 15 in the directions of the straight lines L1, L2, L3, L4 is reduced by the communicating passageways 17, 18, 17', 18'. As a result, the deformation of the exhaust port openings 6*a,* 7*a* and intake port openings 4*a,* 5*a,* resulting from the thermal expansion in the peripheries of the mounting holes 15, is suppressed.

Modifications to the first embodiment are described below.

Figure 5:
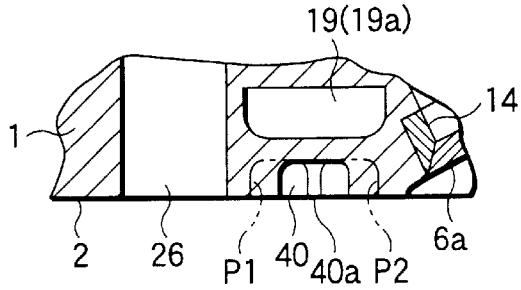
FIG. 5 is a view corresponding to FIG. 4 which shows a second embodiment of the invention.

In the first embodiment, the space portions are provided, when the mating surface 2 (is viewed?) from below as described before, at positions overlapping the straight lines L1, L2 connecting the centers C2, C3 of the exhaust port openings 6*a,* 7*a* with the centers C5 to C8 of the pass-through holes 25 to 28 and the straight lines L3, L4 connecting the centers C9, C10 of the intake port openings 4*a,* 5*a* with the centers C11 to C14 of the pass-through holes 21 to 24 to absorb the thermal expansion of the entireties of the walls of the combustion chambers. In particular, thermal expansion is absorbed in the peripheries of the exhaust port openings 6*a,* 7*a* and intake port openings 4*a,* 5*a* by the communicating passageways 17, 18, 17', 18' consisting of the through holes constituting the coolant passageways. In a second embodiment, as shown in FIG. 5, the space portions may be formed as bottomed recessed portions 40 provided between the combustion chambers 3 and the pass-through holes 25 to 28, as well as between the combustion chambers 3 and the pass-through holes 21 to 24 and have openings 40*a* in the mating surface 2. In this case, too, substantially central portions of the recessed portions 40 in the orthogonal direction occupy positions overlapping the straight lines L1, L2, L3, L4. Then, the widths in the directions of the straight lines L1, L2, L3, L4 and in the orthogonal directions, depth, area and shape of the cross sections of the recessed portions 40 at planes parallel to the mating surface 2, including the openings 40*a* thereof are determined appropriately, as with the communicating passageways 17, 18, 17', 18'. The widths of the recessed portions 40 are determined so as to permit thermal expansion of the entireties of the walls of the combustion chambers, in particular, in the peripheries of the exhaust port openings 6*a,* 7*a* and intake port openings 4*a,* 5*a.* Thus, deformation of the entireties of the walls of the combustion chambers, in particular, in the peripheries of the exhaust port openings 6*a,* 7*a* and intake port openings 4*a,* 5*a,* is suppressed, which is attributed to the thermal expansions.

In this second embodiment, the same operation and effectiveness as those of the first embodiment are provided except for the communicating passageways 17, 18, 17', 18', which are the coolant passageways.

Furthermore, while the recessed portions 40 arranged in the directions of the straight lines L1, L2, L3, L4 are located within the extent of an annular belt portion 20 in the second embodiment, they may be located at any position between the pass-through holes 21 to 28 and the combustion chambers 3. For example, the recessed portions 40 may be located at a position P1 or a position P2 which are both designated by chain double-dashed lines in FIG. 5. Additionally, the recessed portions 40 may be provided such that a plurality of recessed portions 40 are arranged in line with each other in the directions of the straight lines L1, L2, L3, L4 at certain intervals. Thus, the degree at which thermal expansion is permitted can be made large by the plurality of recessed portions 40. Furthermore, in another example of constituting the space portions by the recessed portions, the recessed portions may have openings thereof at any position other than the mating surface 2.

While the communicating passageways 17, 18, 17', 18' which overlap the straight lines L1, L2, L3, L4, when looking at the mating surface 2 from below(,?) are disposed within the annular belt portion 20 in the first embodiment, the communicating passageways 17, 18, 17', 18' may be provided at any position in the direction of the straight lines L1, L2, L3, L4, between the combustion chambers 3 and the pass-through holes 21 to 28. Additionally, recessed portions constituting part of the coolant passageways may be provided as coolant passageways 17, 18, 17', 18' instead of the communicating passageways, which consist of the through holes, and the space portions for permitting thermal expansion may be constituted by the recessed portions. Furthermore, the openings of the recessed portions may be formed in the mating surface 2 or in any portions other than the mating surface 2 which open to the coolant passageway. The latter example will be described below as a third embodiment with reference to FIG. 6.

Figure 6:
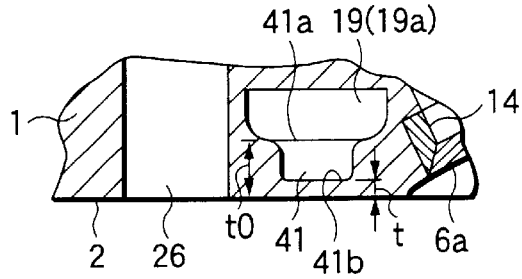
FIG. 6 is a view corresponding to FIG. 4 which shows a third embodiment of the invention.
Figure 7:
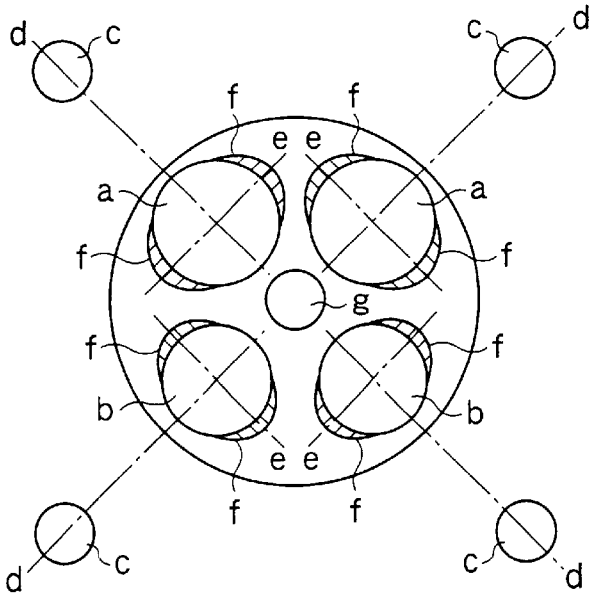
FIG. 7 is an explanatory view showing portions in peripheries of intake port openings and exhaust port openings where thermal stress is generated.

In the third embodiment, which is shown in FIG. 6, recessed portions 41 are provided at the same positions as those where the communicating passageways 17, 18, 17', 18' are provided in the first embodiment and have openings 41*a* which open to an annular coolant passageway 19*a* surrounding the combustion chambers 3. In the third embodiment, the thickness t between a bottom portion 41*b* of the recessed portion 41 and the mating surface 2 is made smaller than the thickness t0 between the bottom portions of the coolant passageway 19*a* other than the portions thereof where the recessed portions 41 are formed and the mating surface 2. Accordingly, the bottom wall of the recessed portion 41 constitutes a thin bottom wall portion of the coolant passageway 19*a*. Due to this, the rigidity of the portions of the coolant passageway 19*a* in the directions of the straight lines L1, L2, L3, L4, which are made thinner by provision of the recessed portions 41, is reduced lower than the rigidity of the portions of the coolant passageway 19*a* other than those where the recessed portions 41 are formed. Therefore, as with the first embodiment, the suppression of thermal expansion by the fastening portions of the cylinder head 1 is alleviated, and the same operation and effectiveness as those of the first embodiment (are?) provided.

While the substantially central positions of the widths of the communicating passageways 17, 18, 17', 18' or the recessed portions in the orthogonal directions occupy the positions overlapping the straight lines L1, L2, L3, L4 when looking at the mating surface 2 from below, the communicating passageways 17, 18, 17', 18' or the recessed portions may be those in which the substantially central positions of the widths thereof in the orthogonal directions do not overlap the straight lines L1, L2, L3, L4 provided that the communicating passageways 17, 18, 17', 18'. Or, the recessed portions are located at positions which overlap the straight lines L1, L2, L3, L4, and specific positions thereof are determined with a view to suppressing the deformation of the entireties of the walls of the combustion chambers. In particular, deformation in the peripheries of the exhaust port openings 6*a,* 7*a* and intake port openings 4*a,* 5*a,* is suppressed, which is attributed to the thermal expansions of the entireties of the walls of the combustion chambers. In particular, deformation in the peripheries of the exhaust port openings 6*a,* 7*a* and intake port openings 4*a,* 5*a* is suppressed by the communicating passageways 17, 18, 17', 18' or the recessed portions. Additionally, the areas and shapes of the cross sections of the communicating passageways 17, 18, 17', 18', including the openings 17*a,* 18*a,* 17'*a,* 18'*a* thereof, or the areas and shapes of the cross sections of the recessed portions, including the openings thereof, may be set optionally.

Furthermore, the space portions may include voids communicating with the outside air or voids which are tightly closed with plugs so as to be blocked off from outside air. In either of the cases, a fluid or a material other than coolant may be loaded in the voids, which can suppress the deformation of the exhaust port openings 6*a,* 7*a* and intake port openings 4*a,* 5*a,* by permitting the thermal expansion in the peripheries of the exhaust port openings 6*a,* 7*a* and intake port openings 4*a,* 5*a* and of the entireties of the walls of the combustion chambers.

In any case, the space portions provided between the combustion chambers 3 and the pass-through holes 21 to 28 may take any form provided that the space portions are such that they are located at the positions which overlap the straight lines L1, L2, L3, L4 when looking at the mating surface 2 from below, and that the portions having a lower rigidity is formed by providing the space portions so that the suppression of thermal expansion by the fastening portions of the cylinder head 1 is alleviated to thereby permit the thermal expansion of the walls of the combustion chambers, in particular, in the peripheries of the exhaust port openings 6*a,* 7*a* and intake port openings 4*a,* 5*a.*

While two intake valves 8 and two exhaust valves 9 are provided in each combustion chamber 3 in the respective embodiments, the numbers of intake valves and exhaust valves are not limited to those numbers.

While only certain embodiments of the invention have been specifically described herein, it will apparent that numerous modifications may be made thereto without departing from the spirit and scope of the invention.

What is claimed is:

1. A cylinder head for an internal combustion engine fastenable to a cylinder block with fasteners, said the cylinder head comprising:

at least one combustion chamber;

at least one intake port opening provided within said at least one combustion chamber;

at least one exhaust port opening provided within said at least one combustion chamber, wherein said at least one intake and exhaust port openings are opened and closed by corresponding intake and exhaust valves, respectively;

a plurality of pass-through holes through which the fasteners pass, wherein each of said pass-through holes is located outside of said at least one combustion chamber; and at least one space portion separated from a corresponding coolant passageway and provided between said at least one combustion chamber and a corresponding pass-through hole, wherein said at least one space portion is located at each position where a straight line connects a center of either one of said at least one intake port opening and said at least one exhaust port opening with a center of said corresponding pass-through hole, when looking at a mating surface of said cylinder head and said cylinder block from below.

2. The cylinder head according to claim 1, wherein said at least one space portion includes a substantially transverse central portion that extends in a direction orthogonal to said straight line.

3. The cylinder head according to claim 1, wherein said at least one space portion is open to said mating surface of the cylinder head.

* * * * *